United States Patent [19]

Dale

[11] 4,301,745

[45] Nov. 24, 1981

[54] HEIGHT ADJUSTABLE TABLE TOPS

[75] Inventor: John G. Dale, Wilmslow, England

[73] Assignee: Hazel Grove Music Company Ltd., Cheadle, England

[21] Appl. No.: 79,963

[22] Filed: Sep. 28, 1979

[30] Foreign Application Priority Data

Dec. 16, 1978 [GB] United Kingdom ..... 48979/78

[51] Int. Cl.[3] ..... A47B 9/00

[52] U.S. Cl. ..... 108/144; 108/73; 108/75; 273/5 B

[58] Field of Search ..... 108/144, 145, 74, 73, 108/75, 84; 273/5 B, 5 C, 4 R, 2; 312/21, 27, 30

[56] References Cited

U.S. PATENT DOCUMENTS

| | | | |
|---|---|---|---|
| 2,092,280 | 9/1937 | Knechtel | 108/84 |
| 2,366,499 | 1/1945 | Tosti | 108/75 |
| 2,544,228 | 3/1951 | Hoppe | 108/145 X |
| 4,123,124 | 10/1978 | Peets | 108/17 X |

FOREIGN PATENT DOCUMENTS

| | | | |
|---|---|---|---|
| 39236 | 9/1936 | Netherlands | 273/5 |
| 15051 | 7/1905 | United Kingdom | 273/5 |

*Primary Examiner*—James T. McCall

*Attorney, Agent, or Firm*—Pearson & Pearson

[57] ABSTRACT

A table has a table top the height of which can be adjusted between an elevated position and a lower position so that the table can be used, for example, both as a billiards table and as a domestic dining table.

Adjustment of the height of the table top is effected with a mechanism, incorporating a support member which can be moved from a retracted position into an extended position at which it acts to support the elevated table top on a support structure. This movement of the support member is effected on lifting of the table top by engagement of a cam follower with a cam surface. Lifting of the table top beyond the elevated position may act to return the support member to its retracted position via engagement of a further cam follower with a further cam surface.

11 Claims, 2 Drawing Figures

HEIGHT ADJUSTABLE TABLE TOPS

Figure 1:
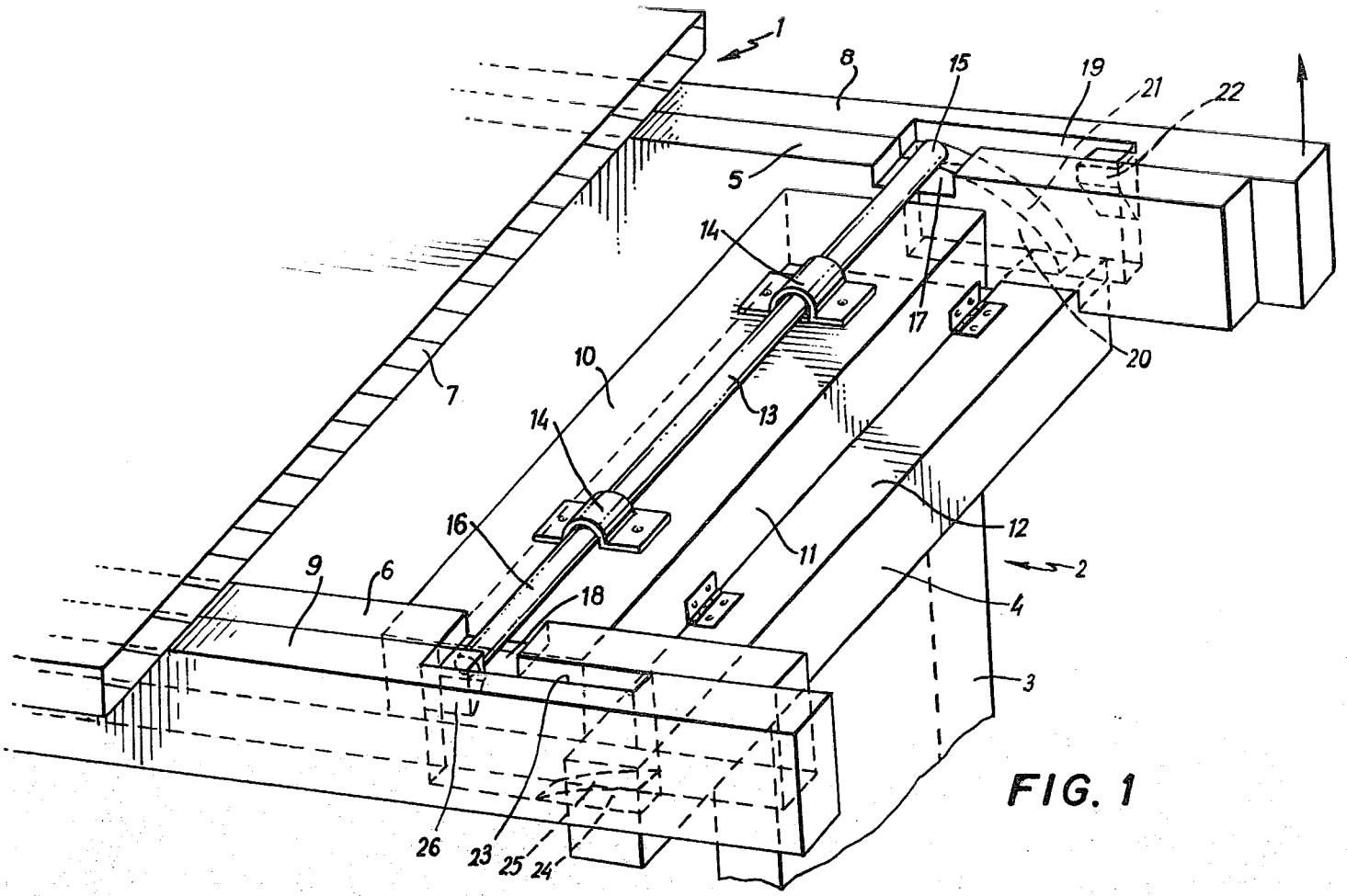

This invention relates to a height adjustable table top and is particularly although not exclusively concerned with a domestic dining table which is convertible to provide a surface for use in playing billiards. Whilst the term billiards is used herein for the sake of convenience, it is to be understood that references to billiards are also intended to encompass references to snooker, pool and other like games.

Domestic dining tables which can be converted at will for use as billiards tables are well-known. With such convertible tables, it is desirable to provide a mechanism capable of adjusting the height of the table top insofar as a greater height is normally required for playing billiards than is the case for dining.

The table top of such convertible table will normally be extremely heavy (especially if this incorporates a slate bed) and one object of the present invention is to provide a height adjusting mechanism which is of simple and inexpensive construction yet which is capable of adequately accommodating such great weight. A further object of the invention is to provide such a mechanism which can be simply and conveniently connected to the table top so that a table can be stored and/or transported with the table top detached and attachment of the top can conveniently be effected subsequently, for example on delivery.

According to the invention therefore there is provided a table having a table top supported on a lower support structure and a height adjusting mechanism between said table top and support structure, said mechanism comprising a rigid support member movably mounted on one of said table top and support structure so as to be movable between an extended position at which it extends between the table top and the support structure to support the former on the latter, and a retracted position at which the table top is supported on the support structure at a lower height, the support member being connected to the other of said table top and support structure via a cam link comprising a cam surface and a cam follower, said cam follower being arranged to move along said cam surface and thereby act to deflect said support member to its extended position when the table top is lifted.

With this arrangement, the said rigid support member need be the only part interposed between the table top and the support structure whereby height adjustment can be effected easily and conveniently with a simple and inexpensive mechanism and whilst ensuring that the table top is always securely supported. Further, the said cam link need be the only part interconnecting the table top and the support structure, and such link, since it involves a cam follower riding on a cam surface, need not involve permanent secure attachment of the table top to the support structure, whereby it may be possible to effect connection and disconnection of the table top and support structure as and when desired in a simple and convenient manner.

Most preferably the said support member is pivotally mounted on the said support structure.

Preferably also, the cam link may have a second cam surface and cam follower arranged to deflect the support member to its retracted position when the table top is lifted above its normal elevated position prior to returning the table top to its lowermost supported position.

The or each cam surface of the cam link may be mounted on a side structure of the table top and the or each cam follower may be defined by one end of a rod mounted on the support member. In a particularly preferred embodiment two cam surfaces are provided respectively on opposite said side structures, each end of the rod is engageable with a respective said surface, and deflectors are provided for moving the rod sideways so that in each supported position of the table top the rod is at a respective position at which only one end thereof can engage its associated cam surface.

Figure 2:
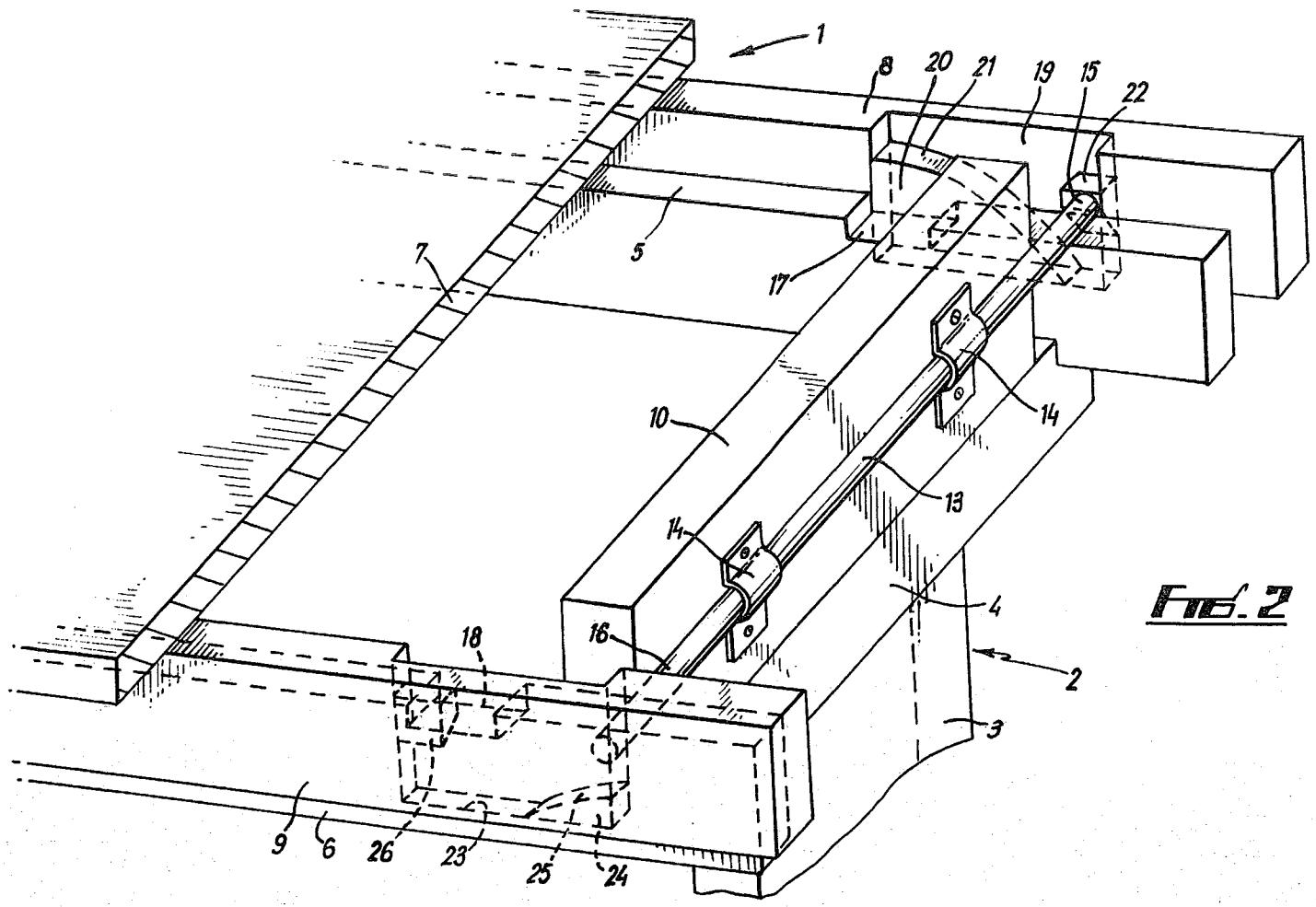

The invention will now be described further by way of example only and with reference to the accompanying drawings in which FIG. 1 is a diagrammatic, perspective view of one end of one form of a table according to the invention; and FIG. 2 is a similar view showing the height adjusting mechanism in its alternative position.

The table can be used as a dining table and also as a billiards table and comprises a rectangular table top 1 supported on a lower floor-standing support structure 2.

The support structure 2 comprises two end leg arrangements 3 which have cross beams 4 at their upper ends, such cross beams 4 being rigidly linked by longitudinally extending side beams 5, 6.

The table top 1 comprises a slate sheet 7 fixed to side rails 8, 9 which extend longitudinally on the outer sides of the side beams 5, 6. The slate sheet 7 is provided with the usual cushions, pockets and a cloth (not shown) so as to provide a playing surface for billiards.

When the table is to be used for dining purposes, the side rails 8, 9 rest on the cross beams 4, the slate sheet 7 rests on the side beams 5, 6 and a wooden cover panel (not shown) is fitted over the table top to cover the playing surface thereof.

When the table is to be used as a billiards table, the cover panel is removed and the top 1 is elevated by means of a height adjusting mechanism. Such mechanism includes a respective elongated wooden block 10 of rectangular cross-section at each end of the table, such block 10 being hinged to the pertaining cross beam 4 and lying between the side beams 5,6.

Such block 10 can pivot between an erected position at which it extends vertically upwardly with a lower longitudinal edge surface 11 thereof resting on the top surface 12 of the cross beam 4, and a retracted position (as shown in the drawing) at which it projects on the inner side of the leg arrangement 3 below the top surfaces of the beams 5,6.

On the outer large surface of the block 10, there is mounted longitudinally a rod 13 the length of which is greater than the longitudinal dimension of the block 10. The rod 13 is mounted in brackets 14 so as to be freely slidable from side to side. In the aforementioned retracted position of the block 10, the two end portions 15, 16 of the rod 13 project beyond the ends of the block 10 and engage recesses 17, 18 in the beams 5,6, thereby to hold the block 10 in a generally horizontal disposition.

On the inner surface of one side rail 8 in the vicinity of the adjacent end of the block 10 there is a recessed portion 19. In this recessed portion 19 there is mounted a cam member 20 having an upper cam surface 21 which curves downwardly towards the adjacent end of the table, and a downwardly tapered wedge 22.

In the retracted position of the block as shown in the drawing the rod 13 is at a position at which the end portion 15 thereof projects beyond the associated recess 17 in the beam 5 into the recessed portion 19 of the rail 8, and rests on the highest part of the cam surface 21. If the outer rails 8, 9 are now lifted by hand, the rod end portion 15 rides on the cam surface 21 and the block 10 is deflected so as to pivot to its upright position. The weight of the rod 13 acts as a counterbalance to facilitate positive movement of the block 10 to such upright position towards the end of its movement.

It will be appreciated that the rails 8, 9 must be lifted high enough to ensure a clearance between a top edge surface of the block 10 and the undersurface of slate sheet 7 during pivoting of the block 10, and, after the block 10 has pivoted to its extended position, the rails 8, 9 are lowered slightly so that the slate 7 now rests on the top edge surface of the block 10 and is thereby securely supported in the elevated playing position thereof. During such slight lowering of the rails 8, 9, the surface of the wedge member 22 engages the end of the rod 13 and moves the rod 13 sideways to a position at which the end portion 15 no longer projects beyond the recess 17 but the opposite end portion 16 now projects beyond its associated recess 18 into a recessed portion 23 in the other rail 9.

In such other recessed portion 23 there is mounted a second cam member 24 having an upper cam surface 25 which curves downwardly away from the adjacent end of the table and a second downwardly tapered wedge 26. In the upright position of the block 10 as described above, the rod end portion 16 rests on the highest part of the cam surface 25.

As and when it is desired to lower the table top to the height suitable for dining purposes, the rails 8, 9 are lifted slightly by hand whereupon the rod end portion 16 rides down the cam surface 25 and the block 10 is thereby deflected to its retracted position, the weight of the rod 13 acting to facilitate movement of the block in this direction after the initial movement thereof. The table top can now be lowered until the rails 8, 9 engage the cross beam 4 and the slate sheet 7 rests on the side beams 5,6. During this lowering operation the wedge 26 engages the rod end portion 16 and moves the rod 13 sideways back to the position shown in the drawing.

The operation of the apparatus is as follows:

On lifting vertically the rails 8 and 9 (as indicated by the arrow in the drawing) the cam surface 21 causes the rod 13 to move in an arcuate path having a center on the hinge axis. The arcuate path is such as to allow the end 15 of rod 13 to clear the corner of recess 17. The block 10 also pivots about the hinge axis until the surface 11 rests on top surface 12 of the cross beam 4. In this position the end 15 of the rod 13 lies in the bottom of recess 19 in side rail 8, between the bottom of the cam surface 21 and the vertical sidewall of recess 19. The side rails 8 and 9 are now lowered vertically so that the table top comes to rest on the now top surface of block 10 and the end 15 of the rod 13 is engaged by cam surface 22, thus forcing the rod 13 longitudinally of itself out of recess 19 and into recess 23 at its other end 16.

The end 16 of rod 13 will now lie in the top right hand corner of recess 23 as viewed in the drawing. On the next occasion that the side rails 8 and 9 are lifted vertically the cam surface 25 rises to engage the end 16 of rod 13 thus forcing the rod 13 to move in the reverse direction along the aforementioned arcuate path. The block 10 is thereby tipped over into the original position as shown in the drawing and the end 16 of rod 13 comes to lie in the bottom left hand corner of recess 23 as viewed in the drawing. The side rails 8 and 9 are then lowered vertically once more so that the end 16 of rod 15 is engaged by cam 26 so as to be moved longitudinally of itself back into the position as shown in the drawing. Repeated lifting and lowering of the side rails 8 and 9 causes block 10 alternately to assume the position shown in the drawing and the upright position described, the rod 13 moving alternately towards and away from the viewer with such lifting and lowering of rails 8 and 9.

With this arrangement it will be seen that height adjustment of the table top can be effected in a simple, convenient and reliable manner utilising a simple and inexpensive mechanism. Also, it will be seen that there is no direct permanent attachment of the table top 1 to the floor-standing structure 2 whereby assembly and dissembly can be much facilitated.

It is of course to be understood that the invention is not intended to be restricted to the details of the above embodiment which are described by way of example only.

Thus, for example, whilst reference is made above to the conversion of a dining table to a billiards table, it is to be understood that the invention is not intended to be restricted to dining/billiards applications. If desired the table of the invention may be convertible between a billiards table and a table-tennis table.

Further, at each side, the respective deflector (22 or 26) and the respective cam (20 or 24) may be united as an integral moulded plastics structure.

I claim:

1. A table having a table top supported on a lower support structure and a height adjusting mechanism between said table top and support structure, said mechanism comprising a rigid support member movably mounted on one of said table top and support structures so as to be movable between an extended position at which it extends between the table top and the support structure to support the former on the latter, and a retracted position at which the table top is supported on the support structure at a lower height, the support member being connected to the other of said table top and support structure via a cam link comprising a cam surface and a cam follower wherein said cam surface is formed on, and said cam follower is attached to, respective ones of said support member and said other of said table top and support structure whereby lifting of said table top relative to said support structure causes said cam follower to move along said cam surface to deflect said support member to its extended position.

2. A table according to claim 1, wherein said support member is mounted on said support structure.

3. A table according to claim 2, wherein said support member is pivotally mounted.

4. A table according to claim 1, wherein said support member comprises a block which extends in erect disposition between the table top and support structure in the said extended position thereof, and wherein the table top is supported directly on said support structure when said block is in the retracted position thereof.

5. A table according to claim 1 wherein the cam link has a second cam surface and cam follower arranged to deflect the support member to its retracted position when the table top is lifted above its normal elevated position prior to returning the table top to its lowermost supported position.

6. A table according to claim 1 wherein each cam surface of the cam link is mounted on a side structure of the table top.

7. A table according to claim 6, wherein each cam follower is defined by one end of a rod mounted on the support member.

8. A table according to claim 7 wherein said two cam surfaces are provided respectively on opposite said side structures, each end of the rod is engageable with a respective said surface, and deflectors are provided for moving the rod sideways so that in each supported position of the table top the rod is at a respective position at which only one end thereof can engage its associated cam surface.

9. A table according to claim 8, wherein a respective said deflector is provided on each said side structure for engagement with the respective rod end to effect deflection thereof.

10. A table according to claim 1 wherein the table top incorporates a billiards playing surface and a removable cover is provided for such surface.

11. A table of the type having a table top supported by a leg structure at a predetermined level above floor level but having a pair of blocks of rectangular cross section, each normally lying on one longer wall, at one of the opposite ends of said structure and each pivotable from recumbant position to erected position, to rest on one shorter wall, to support said table top at a higher predetermined level above floor level characterized by:

a pair of elongated, cam follower rods, each mounted to slide, sidewise of said table, on the upper wall of one of said recumbant blocks and each having its opposite, terminal ends in position to be contacted by cam means; and two pairs of cam means, each cam means of each pair being on an opposite side of said table in position to actuate the adjacent terminal end of one of said cam follower rods for urging said blocks from recumbant to erected position when said table top is lifted and for urging said blocks from erected to recumbant position when said table top is lowered.

* * * * *